US005208631A

United States Patent [19]

Jacobs et al.

[11] Patent Number: 5,208,631

[45] Date of Patent: May 4, 1993

[54] HIGH LIGHT COLOR TONER IDENTIFICATION SCHEME

[75] Inventors: Timothy W. Jacobs, Fairport; David M. Korvick, Pittsford, both of N.Y.

[73] Assignee: Xerox Corporation, Stamford, Conn.

[21] Appl. No.: 803,889

[22] Filed: Dec. 9, 1991

[51] Int. Cl.[5] ..... G03G 21/00

[52] U.S. Cl. ..... 355/204; 355/260; 355/326

[58] Field of Search ..... 355/326, 327, 328, 204, 355/77; 358/80, 75, 78, 81

[56] References Cited

U.S. PATENT DOCUMENTS 4,477,833 10/1984 Clark et al. ..... 358/80
4,941,038 7/1990 Walowit ..... 358/80
4,959,669 9/1990 Haneda et al. ..... 355/326 X
4,992,861 2/1991 D'Errico ..... 358/75
5,093,717 3/1992 Sandrew ..... 358/81
5,105,266 4/1992 Telle ..... 358/80

*Primary Examiner*—A. T. Grimley
*Assistant Examiner*—S. L. Brasé
*Attorney, Agent, or Firm*—Ronald F. Chapuran

[57] ABSTRACT

A technique to identify colorimetric properties of toner contained within a cartridge in a reproduction machine by embedding in a PROM within the cartridge specific coordinates of a color coordinate system and entering the color coordinate information into the data base of the machine to accurately map color data from one color domain such as a full color domain to another color domain such as a highlight color domain.

1 Claim, 2 Drawing Sheets

HIGH LIGHT COLOR TONER IDENTIFICATION SCHEME

BACKGROUND OF THE INVENTION

1. Field of the Invention

This invention relates generally to high light color printing machines and in particular to the color coordinate identification of the toner for correct color mapping.

2. Description of the Prior Art

High light color xerography enables features not possible with one color xerography. Using a tri-level process, for example, it is possible to produce a variety of colors using the two colored toners (usually black and some other color). More accurate duplications of full color originals can be realized by electronic reprographic engines using such a pallet of colors. Generalized color mapping algorithms exist that will map full color image descriptions to two color image descriptions. In order for these algorithms to work, colorimetric values for the two toners must be known.

It is possible to key the toner cartridges in some fashion such as a gross red, blue, or green identification in order that the algorithms know which set of color data to use, based on the key. This prior art method is overly restrictive—only allowing for a few different colors. It becomes difficult, for example to add "Xerox blue" to an array of colored toners because there won't be a key for that color, nor will it's colorimetric values be known to the color mapping algorithms. Furthermore, if a toner color changes slightly because of process or composition variations, the algorithms locked in using one set of colorimetric data for that particular key, possibly producing inferior images.

It is therefore an object of the present invention to provide a new and improved technique for toner identification. It is a further object of the invention to allow a wide variety of color toners to be used while still maintaining efficient color mapping. It is a further object of the invention to provide a precise toner colorimetric identification scheme.

Further advantages of the present invention will become apparent as the following description proceeds and the features characterizing the invention will be pointed out with particularity in the claims annexed to and forming a part of this specification.

SUMMARY OF THE INVENTION

Briefly, the present invention is a technique to identify colorimetric properties of toner contained within a cartridge in a reproduction machine by embedding in a PROM within the cartridge specific coordinates of a color coordinate system and entering the color coordinate information into the data base of the machine to accurately map color data from one color domain such as a full color domain to another color domain such as a high light color domain.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

For a general understanding of the features of the present invention, reference is made to the drawings.

Figure 1:
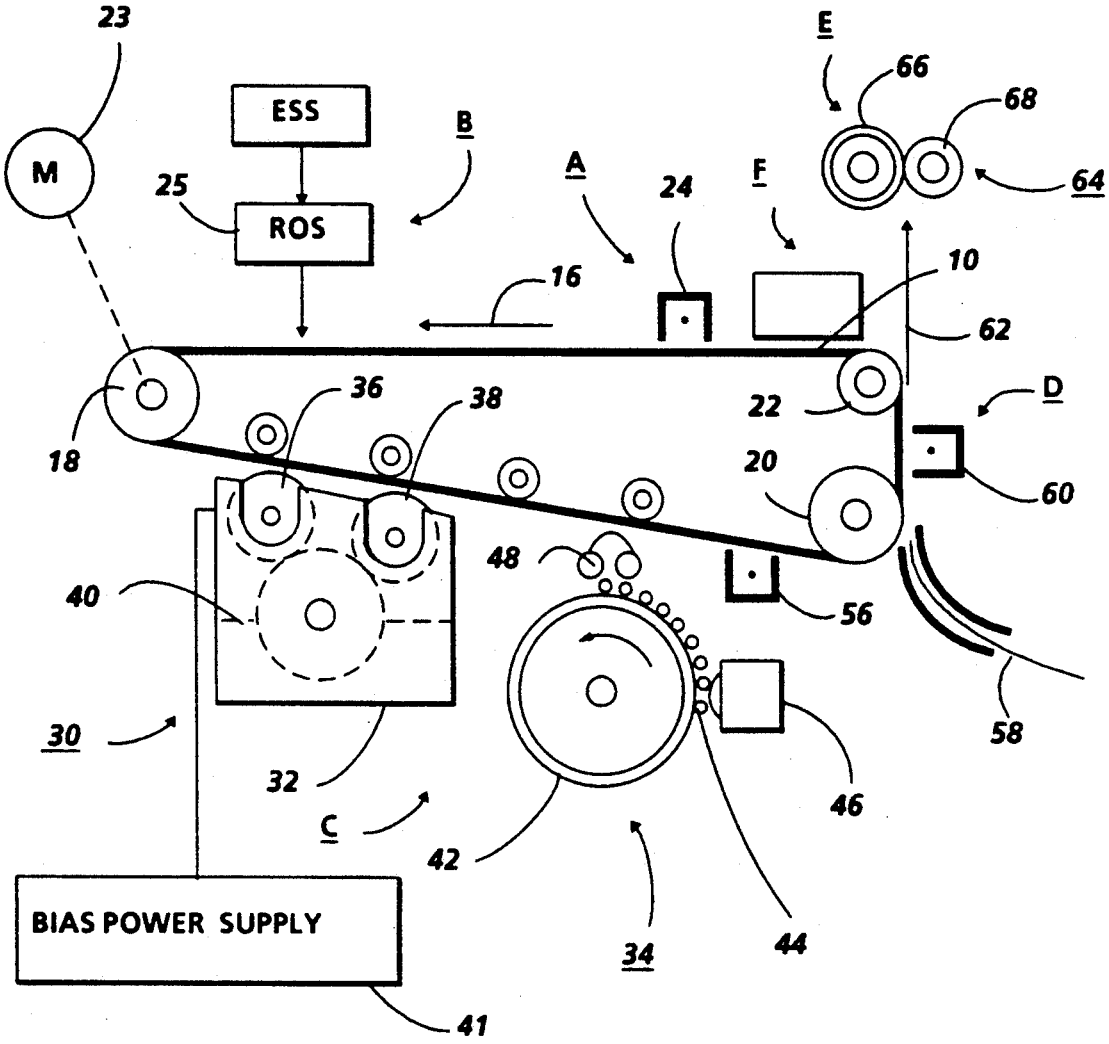
FIG. 1 is an isometric view of an illustrative xerographic reproduction machine incorporating the present invention.

As shown in FIG. 1, a high light color printing machine in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18,20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

Initially, successive portions of belt 10 pass through charging station. A corona discharge device such as a scorotron, corotron or discorotron, indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

At development station C, a development system, indicated generally by the reference numeral 30, advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface. The developer material 40 by way of example contains color toner and magnetic carrier beads. Appropriate electrical biasing of the developer housing is accomplished via power supply 41 electronically connected to developer apparatus 32. A DC bias of approximately −400 volts is applied to the rollers 36 and 38 via the power supply 41. With the foregoing bias voltage applied and the color toner suitable charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferable coated with TEFLON-S (trademark of E.I. Dupont DeNemours) or anodized aluminum.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and a backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 82 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 2B:
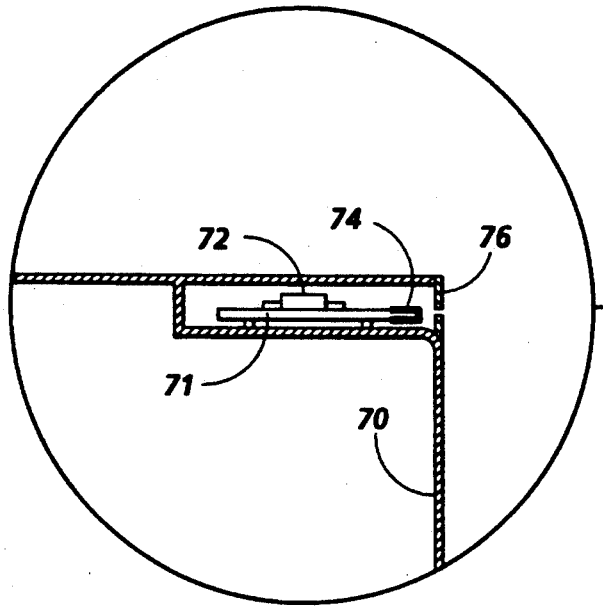
FIGS. 2A and 2B illustrates, the toner identification scheme in accordance with the present invention.
Figure 2A:
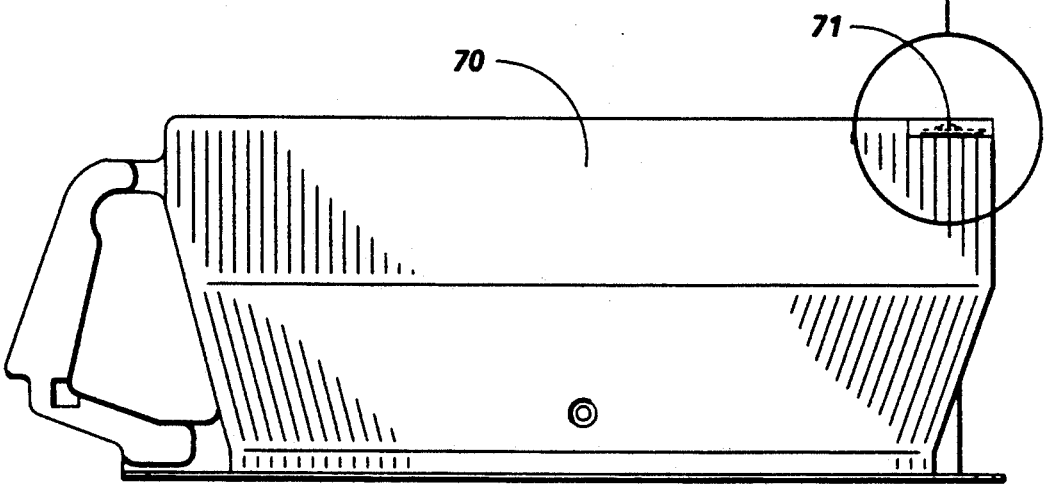
Figure 3:
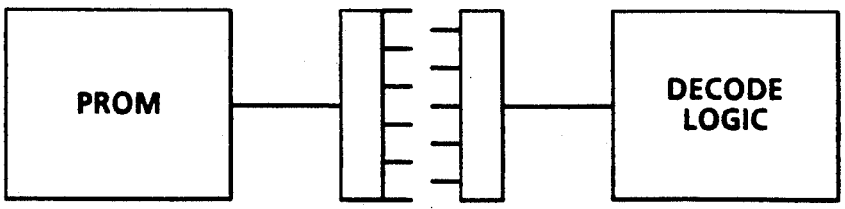
FIGS. 3 illustrates a PROM implementation of the toner identification scheme in accordance with the present invention.

With reference to FIG. 2A, there is generally shown a toner cartridge 70 supporting a card 71 and suitable for incorporation into the machine as illustrated in FIG. 1. The cartridge 70 contains suitable toner for color development in a color highlight machine. An exploded view of the card is shown in FIG. 2B. In a preferred embodiment, a memory device such as a small PROM 72 is mounted on the card 71 with electrical contacts for the address, power, and control lines, the electrical contacts illustrated at 74. Suitable contamination flaps 76 sweep the contacts as the cartridge is inserted into the machine. The electrical contacts 74 on the memory board for PROM 72 engage as the toner cartridge 70 is slid into the machine. The address and decoding logic is illustrated in FIG. 3. The PROM device 72 is electrically connected to the toner cartridge side 78 of a connector as illustrated, and decode logic 80 is interconnected to the marking engine side 82 of the connector. The connector sides 78 and 82 allow coupling of the address, data, and control lines between the PROM device 72 and a reproduction machine.

It should noted that various other information could be embedded or encoded with the cartridge including pertinent toner identification information such as a toner identification number. Such a toner identification number could be used by the machine to determine if the proper toner has been loaded into the engine. In addition, data on the manufacturer and product number of the toner could be encoded to be used in fault analysis and diagnostics. In addition, reorder numbers could be encoded and used to automatically reorder toner.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. A reproduction machine comprising a developer cartridge for developing color images, a control including a decoder for mapping colors from one color space to another color space within the machine, a card attached to the developer cartridge including address, power and control line contacts electrically connected to the decoder, a memory device supported by the card, the memory device identifying within the cartridge specific coordinates of a color coordinate system, the decoder conveying the color coordinate information from the memory device to the control of the machine for mapping colors from one color space to another color space, a connector, one side of the connector coupled to the decoder, the other side of the connector coupled to the memory device, the connector coupling the address, power and control line between the memory device and the machine control.

* * * * *